US011649615B2

(12) United States Patent
Lyons et al.

(10) Patent No.: US 11,649,615 B2
(45) Date of Patent: May 16, 2023

(54) LIFELINE SYSTEM FOR COMPACT HOUSE

(71) Applicant: Lyons House SPC, Oakland, CA (US)

(72) Inventors: Sherry Lyons, San Leandro, CA (US); Lloyd Williams, San Leandro, CA (US)

(73) Assignee: LYONS HOUSE SPC, Oakland, CA (US)

( * ) Notice: Subject to any disclaimer, the term of this patent is extended or adjusted under 35 U.S.C. 154(b) by 34 days.

(21) Appl. No.: 16/906,153

(22) Filed: Jun. 19, 2020

(65) Prior Publication Data

US 2021/0010248 A1 Jan. 14, 2021

Related U.S. Application Data

(60) Provisional application No. 62/871,918, filed on Jul. 9, 2019.

(51) Int. Cl.
*E03B 1/04* (2006.01)

(52) U.S. Cl.
CPC ..... *E03B 1/044* (2013.01); *E03B 2001/045* (2013.01)

(58) Field of Classification Search
CPC ..... E03B 1/044; E03B 1/041; E03B 1/042; E03B 2001/045
See application file for complete search history.

(56) References Cited

U.S. PATENT DOCUMENTS 2,419,319 A * 4/1947 Lankton ..... E04B 1/34869 52/27
3,246,839 A * 4/1966 Steghart ..... F24D 19/10 236/91 C
5,971,303 A * 10/1999 Pugh-Gottlieb ..... E03B 1/044 241/46.013
10,132,083 B1 * 11/2018 Casey ..... C02F 1/003
2009/0205266 A1 * 8/2009 Fennell ..... E03B 1/04 52/79.1
2011/0099918 A1 * 5/2011 Buchmann ..... E04B 1/34869 52/79.1
2012/0110925 A1 * 5/2012 Weber ..... E04D 13/03 52/79.1
2016/0115675 A1 * 4/2016 Quigley ..... E03B 1/042 700/282
2016/0177545 A1 * 6/2016 Robb ..... E03B 1/042 137/2
2018/0266107 A1 * 9/2018 Martinez ..... B29C 44/12
2018/0361906 A1 * 12/2018 Devine ..... H02S 20/30
2019/0345713 A1 * 11/2019 Lolley ..... E04B 1/80

FOREIGN PATENT DOCUMENTS

DE 102008039040 * 2/2010

* cited by examiner

*Primary Examiner* — J C Jacyna
(74) *Attorney, Agent, or Firm* — K&L Gates LLP

(57) ABSTRACT

A compact residential house is disclosed which includes a pre-fabricated installation panel serving as an outer wall of the residential house and a lifeline system pre-installed on an outer surface of the pre-fabricated installation panel, the lifeline system including a grey water system.

8 Claims, 3 Drawing Sheets

LIFELINE SYSTEM FOR COMPACT HOUSE

CROSS-REFERENCE TO RELATED APPLICATIONS

This application claims the benefit of U.S. Provisional Application No. 62/871,918, filed on Jul. 9, 2019, which is incorporated herein by reference in its entirety.

FIELD

The present disclosure relates generally to residential house construction and, more particularly, to a grey water system of a pre-installed installation panel for a compact house.

BACKGROUND

A residential house generally has plumbing, electrical and interior climate control installations. The plumbing installation may include a water supply system with water heater and filtration, etc., plumbing fixtures and a water recycling system. The electrical installation may include an electric meter, a main electrical panel with circuit breakers, power inverter/DC system for solar panels or other power generators. The interior climate control may include heating and cooling systems. In a conventional house, such mechanical equipment are typically scattered at various places, such as some of the plumbing equipment are installed in a crawl space or basement, and most electrical and interior climate control equipment are installed in a garage or a closet. However, such installation in a compact house that does not have either crawl space/basement or garage may pose a challenge.

No matter how small a compact house is, some basic installations are imperative. Such basic installations, which can be called a lifeline system, may include water supply and recycling system, electric meter and electrical panel, and heating and cooling system. In a compact house, all the interior space is essential for living and storages. In addition, compact houses may require speedy construction.

As such, it is desirable to provide a modular exterior lifeline system for compact houses.

SUMMARY

One object of the present invention to provide an easy and speedy way of constructing a compact house.

Disclosed and claimed herein is a compact residential house which includes a pre-fabricated installation panel serving as an outer wall of the residential house and a lifeline system pre-installed on an outer surface of the pre-fabricated installation panel, having a grey water system.

It is further disclosed a method of constructing a grey water system to a pre-fabricated installation panel of a compact residential house.

Other aspects, features, and techniques will be apparent to one skilled in the relevant art in view of the following detailed description of the embodiments.

BRIEF DESCRIPTION OF THE DRAWINGS

The drawings accompanying and forming part of this specification are included to depict certain aspects of the present disclosure. A clearer conception of the present disclosure, and of the components and operation of systems provided with the present disclosure, will become more readily apparent by referring to the exemplary, and therefore non-limiting, embodiments illustrated in the drawings, wherein like reference numbers (if they occur in more than one view) designate the same elements. The present disclosure may be better understood by reference to one or more of these drawings in combination with the description presented herein. It should be noted that the features illustrated in the drawings are not necessarily drawn to scale.

DESCRIPTION

One aspect of the disclosure relates to a wall panel that supports a lifeline system. The idea of the Lifeline System is to build efficient compact houses for low income, homeless people or temporary home for ones who suffer loss of their home through natural disaster like earth quake, hurricane, fire, etc. Since there is a demand, and outside contractors will be constructing the houses, it's important to create a process that would simplify and speed up the construction.

For these purposes, a lifeline system installed on the exterior of a compact house is developed, which eliminates the need for drilling holes into the exterior walls, floor, and roof that can compromise the integrity of the home's airtight building envelope, causing a loss of cooled and heated interior air and drafts. Embodiments of the present disclosure will be described hereinafter with reference to the attached drawings.

Figure 1A:
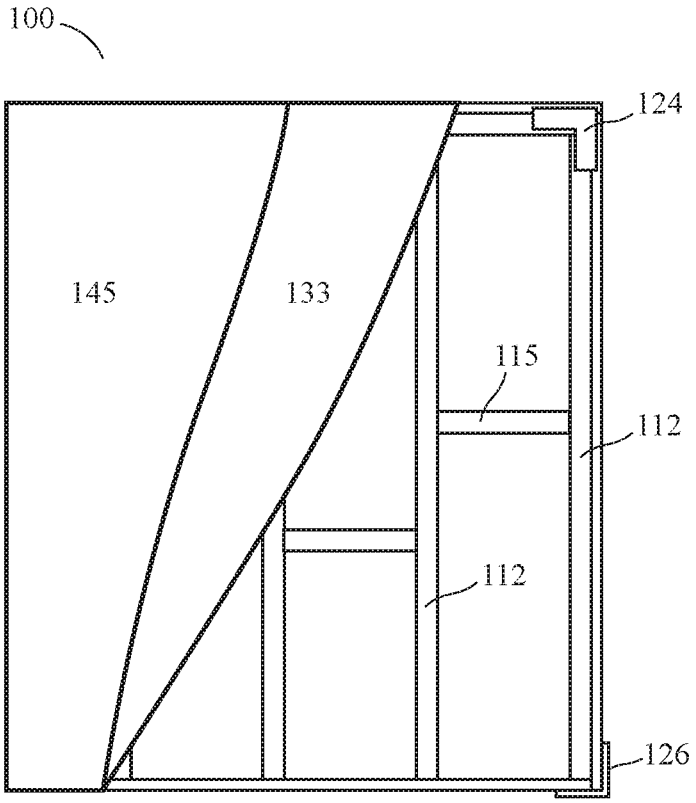
FIGS. 1A and 1B illustrate an installation panel for mounting a lifeline system of the present disclosure.
Figure 1B:
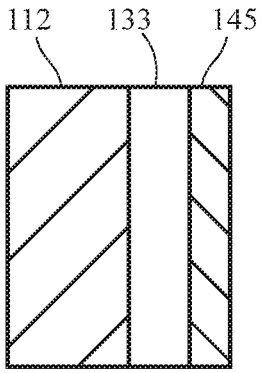

FIGS. 1A and 1B illustrate an installation panel 100 for mounting a lifeline system of the present disclosure. Referring to FIG. 1A, the installation panel 100 is made from a panel frame exemplarily built with 2×4 studs 112 and 115 reinforced by corner braces 124 and 126. In exemplary embodiments, a ¾" plywood panel 133 is nailed onto studs 112, 115 which together form the panel frame. Secured on top of the plywood panel 133 is a layer of heat and sound insulation aluminum foil 145. The finished installation panel 100 must be strong enough to hoist a fully equipped panel with a crane. In exemplary embodiments, the installation panel 100 is pre-fabricated along with the lifeline system in a factory. The size of the installation panel 100 can be standardized and provided to compact house designers to design the compact houses accordingly. In embodiments, the installation panel 100 is pre-fabricated to a customer order in a factory, and transported to and received at a house site in time of construction.

Referring to FIG. 1B which illustrates a cross-section of the installation panel 100, the plywood panel 133 is layered on one side of the panel frame 112; and the heat and sound insulation aluminum foil 145 is layered on top of the plywood panel 133, wherein plywood panel 133 is sandwiched between panel frame and insulation aluminum foil 145.

Figure 2:
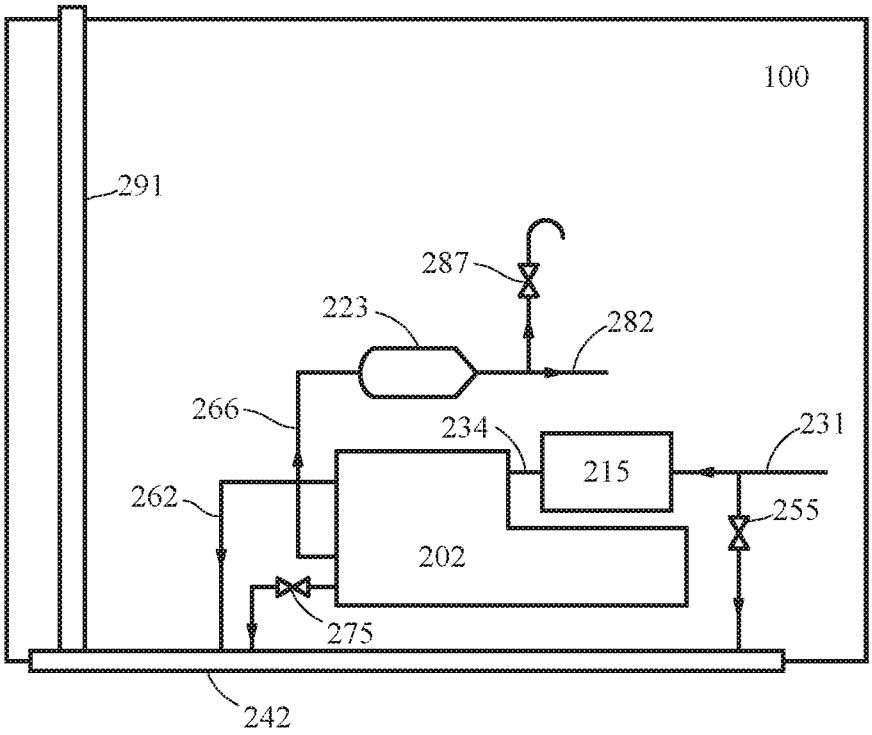
FIG. 2 illustrates a grey water system of a lifeline system of the present disclosure installed on the installation panel shown in FIGS. 1A and 1B.

FIG. 2 illustrates grey water system of a lifeline system of the present disclosure installed on the installation panel 100 shown in FIGS. 1A and 1B. The grey water system includes a grey water tank 202, a coarse filter 215 and an in-line pump 223. Waste water drained from showers and bathroom sinks flow into the coarse filter 215 via a first pipeline 231. The waster water may also be diverted to a sewer line 242 at the control of a valve 255. The filtered waste water enters the grey water tank 202 via a pipeline 234. The grey water tank 202 is equipped with an overflow pipeline 262 and an automatic valve 275 connected to the bottom of the grey water tank 202 and empties the grey water tank 202 to the sewer line 242 every 24 hours according to California Code of Regulation, Title 22. The in-line pump 223 is connected to the grey water tank 202 via a second pipeline 266 and pumps filtered waster water to toilet fill line 282 as well as a hose spigot 287 for outside use, such as gardening, plant watering, car wash or driveway cleaning. As shown in FIG. 2, a vent pipe 291 connected to the sewer line 242 is exemplarily mounted to the installation panel 100.

Figure 3:
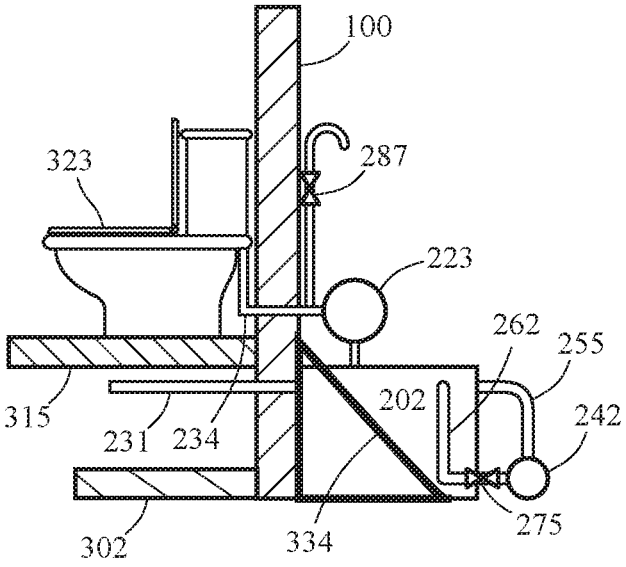
FIG. 3 is a cross-sectional view of a lifeline system shown in FIG. 2 mounted to a base of a compact house.

FIG. 3 is a cross-sectional view of the lifeline system shown in FIG. 2 that is mounted close to a base of a compact house. The lifeline system mounted to the installation panel 100 includes a grey water tank 202 and an in-line pump 223, etc. The installation panel 100 is aligned to a base 302 of a compact house. As shown in FIG. 3, a floor 315 of the compact house having an illustrative toilet 323 is higher in elevation than the grey water tank 202. Such design allows the waste water tank 202 to be gravity fed; and also allows plumbing of the compact house such as drain pipeline 231 to enter through the insulated floor 315 and not the exterior walls.

As shown in FIG. 3, the grey water tank 202 is secured to the installation panel 100 by a rack structure 334, which can be exemplarily made of a rust resistant metal as the entire lifeline system may be exposed to the outside.

Although FIG. 3 only illustrates that the installation panel 100 serves as a wall structure of the compact house, in other embodiments, an additional wall structure may be added juxtaposing the internal surface of the installation panel 100 for added support.

Figure 4:
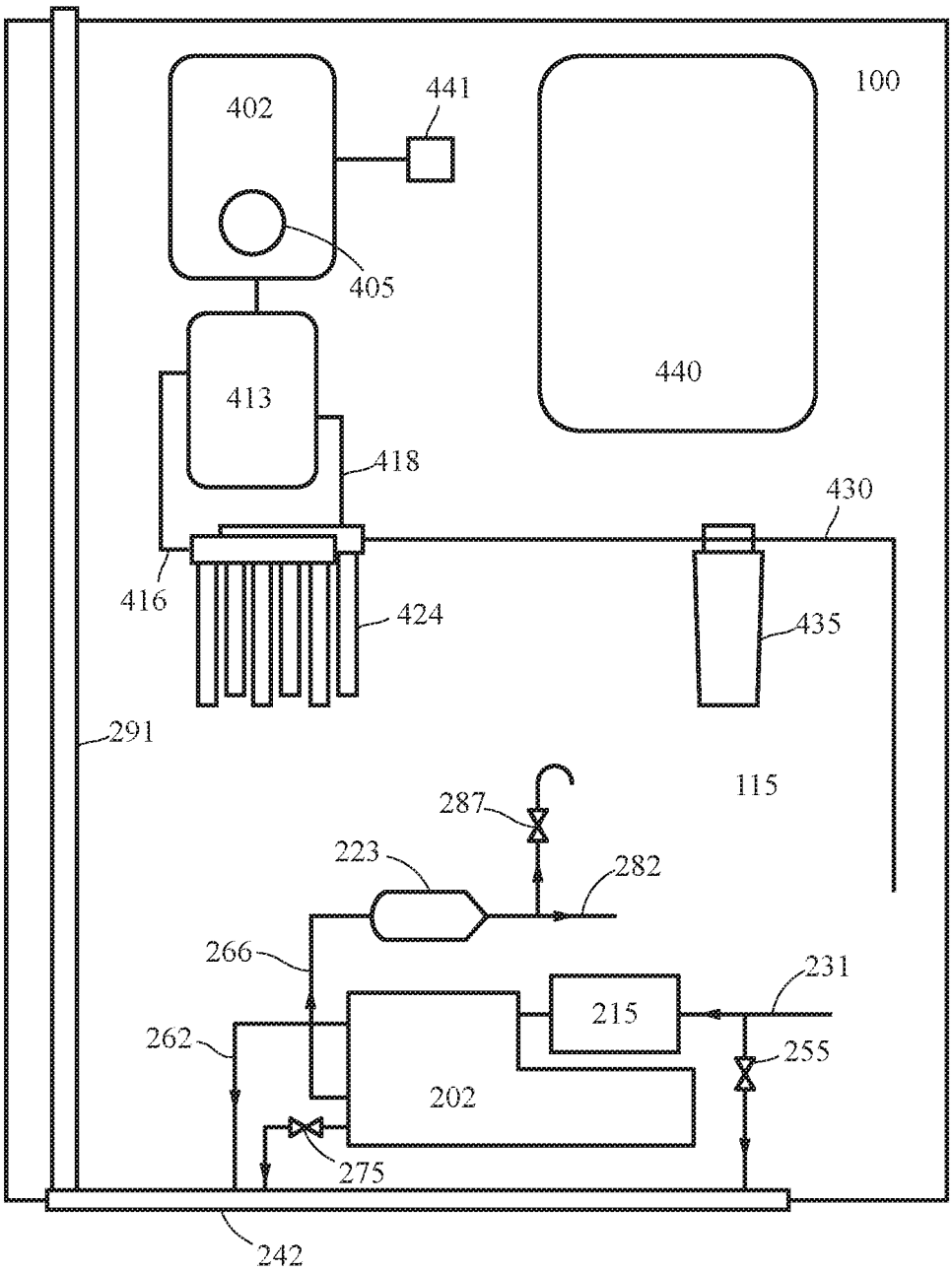
FIG. 4 illustrates various components of a lifeline system of the present disclosure.

FIG. 4 illustrates various components of a lifeline system of the present disclosure. The installation panel 100 can be designed to install various pieces of equipment according to a customer's order. As shown in FIG. 4, beside the grey water system shown in FIGS. 2 and 3, an electric panel 402, an electric water heater 413, a solar transformer 440, a PEX plumbing manifold 424 and a whole-house water filter 435 are installed on the installation panel 100. The electric panel 402 may be wired to a power grid (not shown) and has an electric meter 405 for recording electricity usage. The solar transformer 440 may be wired to the power grid through the electric panel 402. In an exemplary embodiment, the solar transformer 440 may have built-in battery storage as well as a power inverter/DC system for solar panels. Electric power from the electric panel 402 is then supplied to the electric water heater 413 for providing hot waters to the compact house. In addition, a power outlet 441 wired to the electric panel 402 may also be built into the installation panel 100. The water heater 413 exchanges water with the PEX plumbing manifold 424 through an inlet pipeline 416 and an outlet pipeline 418. Water supplied to the PEX plumbing manifold 424 and the water heater 413 is supplied by a main pipeline 430 through a whole-house water filter 435.

In other embodiments, the lifeline system shown in FIG. 4 may include an air conditioning unit (not shown) also mounted on the installation panel 100. By design the installation panel 100 may designate certain spot for certain equipment, but whether the equipment is installed is determined by a customer order. In exemplary embodiments, the installation panel 100 can be customized to fit a compact house design. The centralized lifeline system design is not limited to compact house, and may be fitted in an existing house as well as a new construction of regular houses.

The embodiments in the lifeline system shown in FIG. 4 may be enclosed in a cabinet (not shown) to protect it from the environment, burglar and/or vandalism, as the lifeline system is mounted on the outer surface of the installation panel 100 and exposed to the outside.

As the lifeline system of the present disclosure can be pre-installed on the installation panel 100, plumbers and electricians can quickly and easily install the rest of the plumbing and electrical utilities for the compact house.

While this disclosure has been particularly shown and described with references to exemplary embodiments thereof, it shall be understood by those skilled in the art that various changes in form and details may be made therein without departing from the spirit of the claimed embodiments.

What is claimed is:

1. A pre-fabricated installation panel assembly for a residential house, comprising:

a single installation panel configured to serve as an outer wall of the residential house, wherein the single installation panel comprises: a panel frame; a heat and sound insulation layer; and a wood panel disposed between the panel frame and the heat and sound insulation layer; and a lifeline system pre-installed on an outer surface of the single installation panel, the lifeline system comprising:

a water distribution system having pipelines, wherein water is distributed through the pipelines of the water distribution system to the residential house; and an electric system having an electric panel configured to supply electric power, wherein the electric system is in communication with the water distribution system, wherein the water distribution system and the electric system are pre-installed on the outer surface of the single installation panel made with the panel frame, the heat and sound insulation layer, and the wood panel before the single installation panel is installed at a house site for building the residential house, wherein the pre-fabricated installation panel further comprises:

a waste water tank pre-installed on the outer surface of the single installation panel, wherein the waste water tank is configured to receive filtered waste water; and a toilet fill line configured to transmit the filtered waste water in the waste water tank to a toilet of the residential house.

2. The pre-fabricated installation panel assembly of claim 1, wherein the water distribution system comprises a water heater configured to provide hot water to the residential house.

3. The pre-fabricated installation panel assembly of claim 1, wherein the water distribution system comprises a water filter.

4. The pre-fabricated installation panel assembly of claim 1, further comprising a power meter configured to record electricity usage, wherein the power meter is pre-installed on the outer surface of the single installation panel before the single installation panel is installed at the house site for building the residential house.

5. The pre-fabricated installation panel assembly of claim 1, further comprising a solar transformer, wherein the solar transformer is pre-installed on the outer surface of the single installation panel before the single installation panel is installed at the house site for building the residential house.

6. The pre-fabricated installation panel assembly of claim 5, wherein the solar transformer comprises at least one of a battery and a power inverter/DC system for solar panels.

7. The pre-fabricated installation panel assembly of claim 1, wherein the heat and sound insulation layer comprises an aluminum foil.

8. A lifeline system for a residential house, comprising:

a single panel configured to be installed on a wall of the residential house, the single panel comprising:

an electrical panel configured to provide power distribution of electricity to the residential house; and a plumbing manifold configured to exchange water to the house, wherein the electrical panel and the plumbing manifold are pre-installed on the outer surface of the single panel made with a heat and sound insulation layer and a wood panel before the single panel is installed at a house site for building the residential house, wherein the lifeline system further comprises:

a waste water tank pre-installed on the outer surface of the single installation panel, wherein the waste water tank is configured to receive filtered waste water; and a toilet fill line configured to transmit the filtered waste water in the waste water tank to a toilet of the residential house.

* * * * *